US006789290B2

(12) United States Patent
Kent et al.

(10) Patent No.: US 6,789,290 B2
(45) Date of Patent: Sep. 14, 2004

(54) DUAL MODE CARPET CLEANING DEVICE

(75) Inventors: Roger Kent, Plano, TX (US); Frank Stephan, Fenton, MO (US); Schubert Pereira, Chesterfield, MO (US)

(73) Assignee: Rug Doctor, L.P., Plano, TX (US)

( * ) Notice: Subject to any disclaimer, the term of this patent is extended or adjusted under 35 U.S.C. 154(b) by 0 days.

(21) Appl. No.: 09/898,584

(22) Filed: Jul. 2, 2001

(65) Prior Publication Data

US 2003/0046788 A1 Mar. 13, 2003

(51) Int. Cl.[7] ..... A47L 9/02
(52) U.S. Cl. ..... 15/322; 15/321
(58) Field of Search ..... 15/320, 321, 322, 15/329, 339

(56) References Cited

U.S. PATENT DOCUMENTS

| | | | | |
|---|---|---|---|---|
| 3,939,527 A | | 2/1976 | Jones | 15/353 |
| 3,974,541 A | | 8/1976 | Silvis et al. | 15/320 |
| 4,168,563 A | | 9/1979 | O'Bryan | 15/321 |
| 4,308,636 A | | 1/1982 | Davis | |
| 4,458,377 A | | 7/1984 | Frohbieter | 15/320 |
| 4,580,309 A | | 4/1986 | Ogden | 15/300 |
| 4,651,380 A | | 3/1987 | Ogden | 15/321 |
| 4,670,113 A | | 6/1987 | Lewis | 204/80 |
| 4,803,753 A | | 2/1989 | Palmer | 45/320 |
| 4,809,397 A | | 3/1989 | Jacobs et al. | 15/320 |
| 4,934,017 A | | 6/1990 | Kent | 15/321 |
| 4,956,891 A | | 9/1990 | Wulff | |
| 5,146,647 A | | 9/1992 | Blase et al. | 15/321 |
| 5,147,467 A | | 9/1992 | Virtue | 134/18 |
| 5,455,982 A | * | 10/1995 | Armstrong et al. | 15/320 |
| 5,473,792 A | | 12/1995 | Kent et al. | 15/320 |
| 5,584,094 A | | 12/1996 | Gurstein | |
| 5,661,120 A | | 8/1997 | Finucane et al. | |
| 5,839,159 A | | 11/1998 | Karr et al. | 15/355 |
| 6,052,861 A | | 4/2000 | Keller | |
| 6,082,376 A | | 7/2000 | Karr et al. | 134/6 |
| 6,192,548 B1 | * | 2/2001 | Huffman | 15/320 |
| 6,192,549 B1 | | 2/2001 | Kasen et al. | 15/337 |
| 6,206,980 B1 | * | 3/2001 | Robinson | 15/321 |
| 6,243,914 B1 | | 6/2001 | Studebaker | |
| 6,247,202 B1 | * | 6/2001 | Lesco et al. | 15/320 |
| 6,362,149 B1 | | 3/2002 | Man et al. | |
| 6,647,585 B1 | * | 11/2003 | Robinson | 15/322 |
| 2001/0000452 A1 | | 4/2001 | Kochanowicz et al. | |

FOREIGN PATENT DOCUMENTS

| | | |
|---|---|---|
| DE | 100 27 636 | 12/2001 |
| EP | 1 092 803 | 4/2001 |
| FR | 2 148 939 | 3/1973 |
| WO | WO-94/07980 | 4/1994 |

OTHER PUBLICATIONS

Copyright 2001 by *Business News Publishing Co.*, Arpi Nalbandian, Editor.

* cited by examiner

*Primary Examiner*—Theresa T. Snider
(74) *Attorney, Agent, or Firm*—Thompson Coburn LLP

(57) ABSTRACT

A dual mode carpet cleaning machine capable of being used in both a traditional deep cleaning mode and a fast drying surface cleaning mode. A selection mechanism provides selective communication with different sets of application jets. One set of application jets delivers a first cleaning solution that penetrates deeply into a carpet. After agitation with a scrub brush the device removes the cleaning solution and unwanted soil through a vacuum nozzle. The other set of jets delivers a lower flow rate of a second cleaning solution that does not penetrate deeply into the carpet. In addition, a novel cleaning solution is disclosed for use with the machine in differing concentrations, depending on the desired application. The carpet cleaning solutions dry more quickly when applied to carpet than previous solutions; the combined performance of the system displays similar cleaning efficiencies to previous carpet cleaning machines but obtains significantly reduced drying times.

24 Claims, 7 Drawing Sheets

DUAL MODE CARPET CLEANING DEVICE

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

FIELD OF THE INVENTION

This invention relates to cleaning machines, carpet cleaning solutions, the system incorporating the cleaning machines and carpet cleaning solutions, and methods of cleaning carpet. Specifically, the carpet cleaning machine of the present invention is capable of operating in either a surface cleaning mode and a deep cleaning mode, or alternatively, a fast drying mode and a longer drying mode.

BACKGROUND OF THE INVENTION

Currently, machines for cleaning carpets consist of a system for delivering a cleaning solution, typically a hot aqueous detergent solution, to a carpet and a system for vacuuming the applied cleaning solution from the carpet. Many of these machines also have rotating brushes or beater bars to work the cleaning solution into the carpet and to aid in the dislodging of dirt and other debris from the carpet fibers.

The system for delivering the cleaning solutions in these machines usually includes a tank for holding the solution and a pump for pumping solution from the tank to a spray nozzle chamber. The spray nozzle chamber then distributes the cleaning solution to the carpet. The system for vacuuming generally comprises a vacuum chamber disposed in a cleaning head positioned over the carpet (The term "carpet" is defined to also include rugs.). The brushes then scrub the carpet. Next, a vacuum pump in fluid communication with the vacuum chamber and nozzle generates suction to remove the solution applied to the carpet.

These cleaning systems come in various varieties. The first variety is a deep clean system in which the tanks, the delivery system, the removal system and the brush are all contained on a moveable cart. A cleaning solution is applied to the carpet through various applying mechanisms that allow the solution to penetrate to the carpet backing material and remove unwanted dirt. The dirt/solution mix is subsequently removed by the vacuum. U.S. Pat. Nos. 5,473,792, 4,809,397 and 4,803,753 are examples of these machines. In this deep cleaning variety, the carpet is first administered a high pressure stream of cleaning solution, then scrubbed or otherwise agitated, and finally subjected to a vacuum to remove the solution and unwanted soil. This type of application provides thorough cleaning, and penetrates to the carpet backing material with the cleaning solution. As a result the carpet takes usually at least four to seven hours, or longer to dry. Long drying times make it logistically difficult to deep clean carpets in high traffic areas. As a result, many businesses are unable to deep clean carpets more than once a year.

Other varieties of cleaning systems include petroleum powder, dry cleaning, SORI (Spray On Rub In), and shampoo. The petroleum powder system involves spraying on a petroleum powder that binds to dirt. However, powder removal is never complete, and the remaining powder residue continues to attract dirt, making the carpet dirtier. The dry cleaning system involves applying dry cleaning chemicals to the carpet which can create environmental concerns. The SORI system is for spot cleaning where carpet cleaner is sprayed onto carpeting, and hand scrubbed. The shampoo system requires a shampoo solution containing a relatively small amount of water to be applied to the carpet. A bonnet on a machine is used to absorb the solution-dirt mixture from the surface of the carpet.

Currently, a machine does not exist that can be used for both a traditional deep cleaning application and a faster drying surface cleaning application. In addition, a cleaning solution does not exist that is designed for use in both a deep cleaning application and a surface cleaning application. Although numerous examples of cleaning solutions and powders are known in the art, none are specifically formulated to be used in both deep cleaning and surface cleaning varieties.

Additionally, neither a system using a dual mode carpet cleaning machine using a fast drying solution, nor methods of using such a system exist in the art. Therefore, what is needed is 1) a dual mode carpet cleaning machine that operates in a fast drying, surface cleaning mode and a longer drying, deep cleaning mode; 2) a fast drying carpet cleaning solution that will penetrate the carpet to the carpet backing mixed at one concentration and that will not penetrate the carpet to the carpet backing at another concentration; 3) a system using the dual mode carpet cleaning machine and fast drying carpet cleaning solution; and 4) methods of using such a system. Each of these features result in faster carpet drying times while retaining high cleaning efficiency.

BRIEF SUMMARY OF THE INVENTION

The present invention is drawn to the next generation of carpet cleaning machines and cleaning agents. The invention solves the above mentioned problems and will allow a user the ability to use the same machine and the same cleaning solution to either deep clean or surface clean a carpet, resulting in faster drying times while retaining high cleaning efficiencies. The invention empowers the user of the carpet cleaning machines and carpet cleaning solutions of the invention to choose whether they want to clean the surface of a carpet and quickly have the carpet available for use, or deeply clean the carpet for sanitary or other reasons when time has been allowed for longer drying times. Hotels and other businesses would greatly benefit from such an invention when carpets need to be cleaned quickly between guests or business hours, but provide the hotel or other business the option of deep cleaning carpets using the same machine and carpet cleaning solution when time is not of the essence.

One aspect of the invention is to provide an improved machine that allows the easy selection of either a deep cleaning mode or a surface cleaning mode, or alternatively a longer drying time mode or a faster drying time mode. By the simple change of the selection mechanism, the machine will adjust the physical characteristics of the delivered cleaning solution and thus the manner in which the cleaning solution interacts with the rug or carpet, prior to being removed by the vacuum. This in turn enables the user to control the carpet drying time.

Another aspect of the invention is to provide a new cleaning solution. The new cleaning solution has characteristics that allow it to be diluted into a mixture for use in both a longer-drying, deep-cleaning application as well as a fast-drying, surface-cleaning application by changing the solution concentration in the water. Even with a single mode, deep cleaning machine, the improved cleaning solution shows faster carpet drying times over prior art mixtures, without the use of alcohol or other volatile flammable solvents.

The cleaning solution of the present invention is formed by diluting a specific amount of cleaning mixture with clean water. The cleaning mixture has a combination of surfactants, detergents and wetting agents optimized for use in a surface cleaning application, but also formulated to deep clean carpets. An additional benefit of the solution of the invention is that it imparts cleaning efficiencies that are similar to the efficiencies of prior art cleaning solutions while at the same time providing for a substantial reduction in carpet drying time over the prior art. A key property of the carpet cleaning mixture is that it creates a foam when mixed with water at a lower concentration, but creates a gel-like higher viscosity foam when mixed with water in a higher concentration. Preferably, the higher concentration is about twice as concentrated as the lower concentration. The gel-like foam produced upon agitating the solution at this concentration imparts increased foam stability while other components enhance sheeting action. The combination of the lower application rate and the creation of this foam prevents deep penetration of the cleaning solution into the carpet prior to removal by the vacuum system. This results in a surface-cleaned carpet that typically dries in less than two hours as compared to four-to-seven hours or more of current carpet cleaning systems.

Yet another aspect of the invention is to provide a dual mode carpet cleaning system using the dual mode cleaning machine and the fast drying cleaning mixture.

A further aspect of the invention is to provide a method of cleaning carpet. The method comprises the steps of mixing the concentrated carpet cleaning solution at a concentration such that a foam produced by agitating the carpet cleaning solution does not penetrate the carpet to the carpet backing, placing the mixed carpet cleaning solution into the dual mode carpet cleaning machine, selecting a fast dry mode of the carpet cleaning machine, and applying the carpet cleaning solution to the carpet fibers.

Further features and advantages of the present invention as well as the structure, composition and operation of various embodiments of the present invention, are described in detail below with reference to the accompanying drawings.

DETAILED DESCRIPTION OF THE INVENTION

Referring to the accompanying drawing in which like reference numbers indicate like elements, the machine, the cleaning mixture and the system of the present invention are set forth below.

A. The Machine

Referring now to FIGS. 1–4 it can be seen a portable self-contained carpet cleaning machine is shown generally at 10 in accordance with the present invention. Machine 10 includes a main support housing, shown generally at 12, having an application and extraction section shown generally at 14, a storage section 16, and a removal section shown generally at 18. A handle 20 is attached to the support and wheels 24 allow machine 10 to be rolled.

Figure 3:
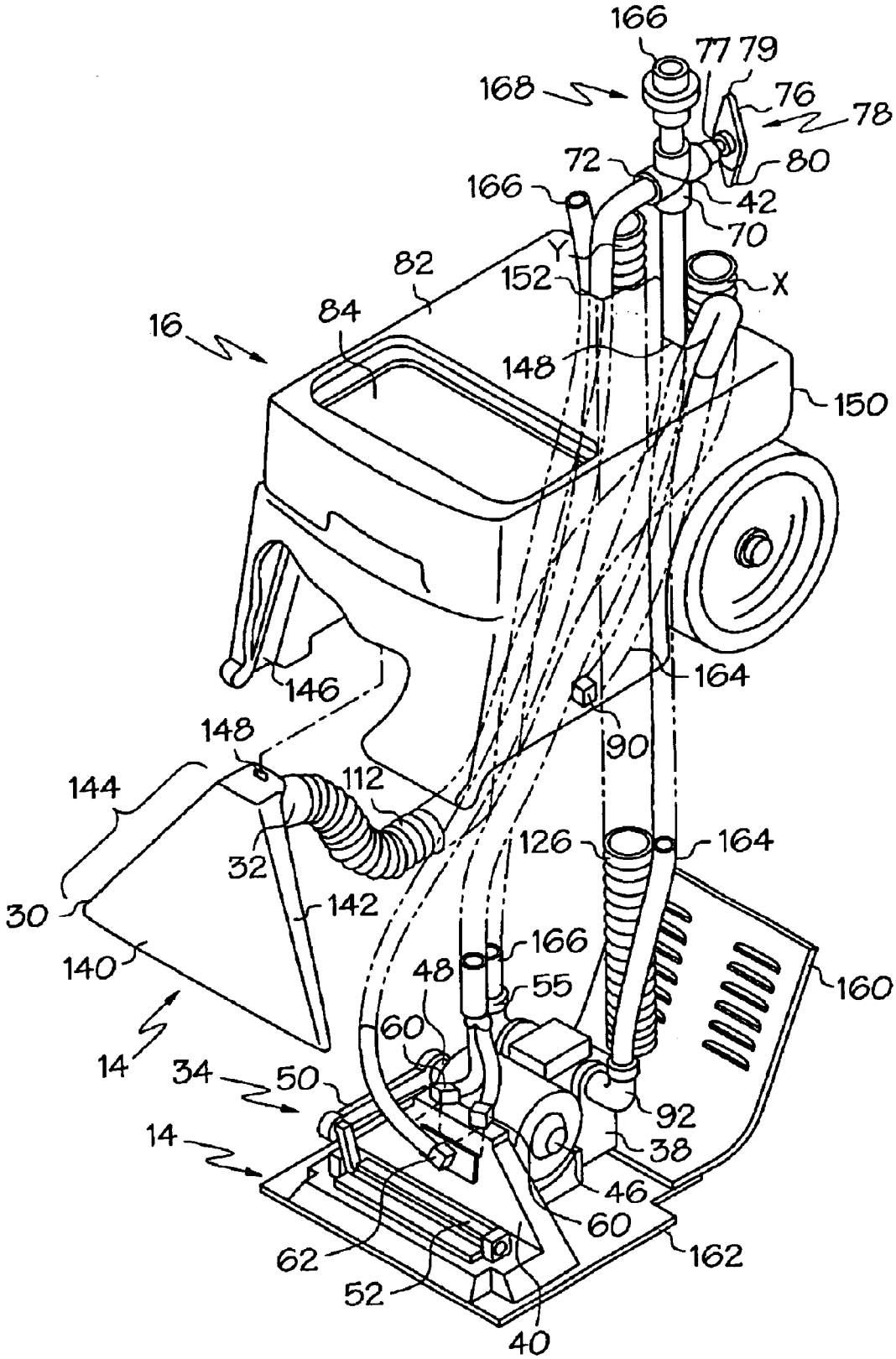
FIG. 3 illustrates an elevated, perspective exploded view of a storage section and an application and extraction section of the carpet cleaning machine of the present invention.
Figure 4:
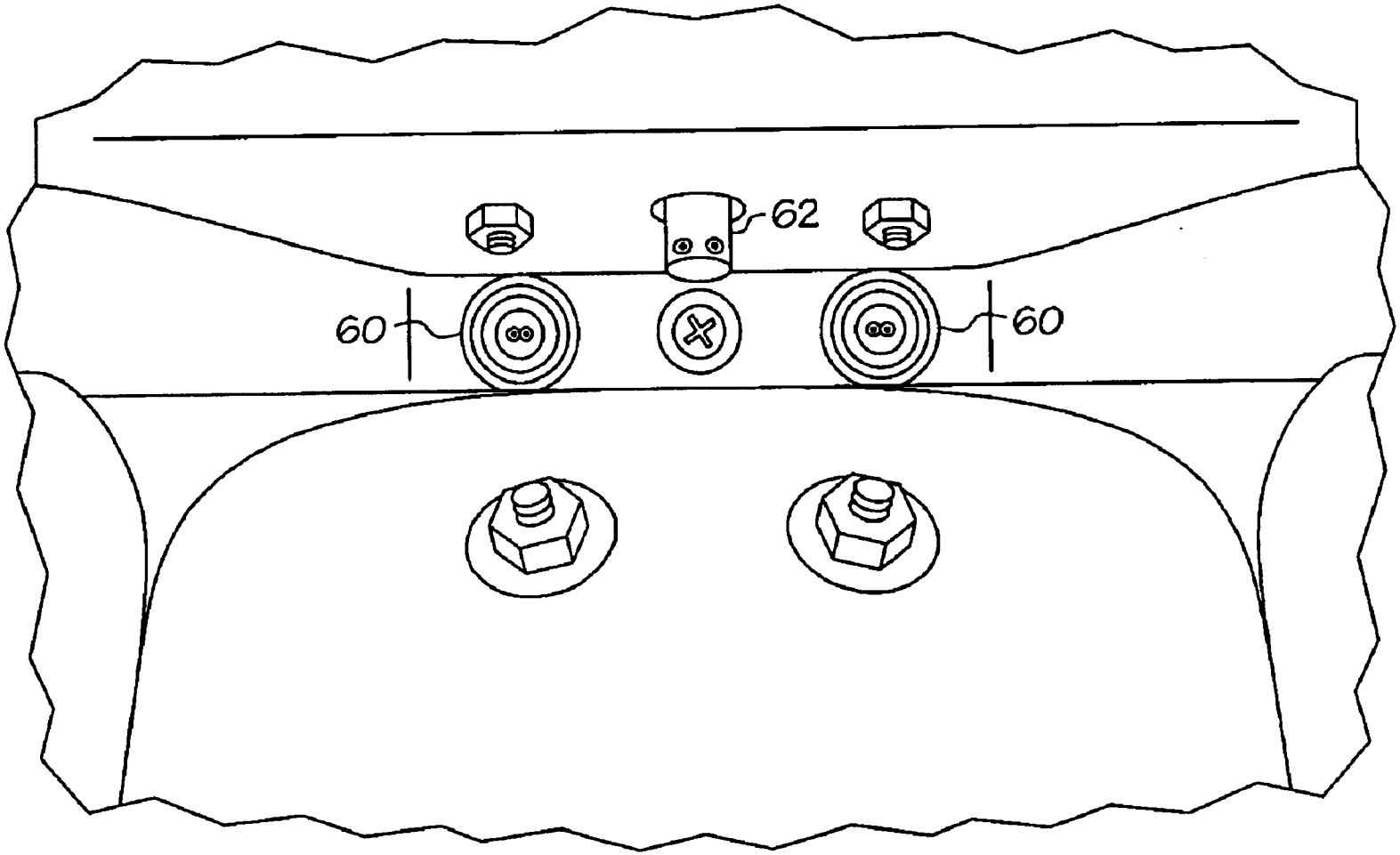
FIG. 4 illustrates a detailed perspective view of jet tip nozzles of the carpet cleaning machine of the present invention.

As shown in FIG. 3, the application and extraction section 14 includes a vacuum nozzle 30 attached to a removal conduit 32, a brush assembly shown generally at 34, solution pump 38, spray nozzle chamber 40 and a ball valve 42. The brush assembly 34 uses a motor 46 with off-center drive shaft 48 to drive link member 50 linked to a brush 52 (bristles not shown in this top view) which drives the brush 52 back and forth between the vacuum nozzle 30 and the spray nozzle chamber 40. The solution pump 38 pumps cleaning solution (not shown) to the spray nozzle chamber 40 through solution pump outlet 55. The machine 10 may be produced using a range of nozzle spraying patterns, varying in length, width, dispersion, and other geometrical configurations. The spray nozzle chamber 40 is equipped with both a deep cleaning jet tip 60 (preferably model H1/8 VV-KY11010 for narrower width spraying such as in a Rug Doctor Mighty Pack machine or model 1/8HVV KY11006 for wider spraying such as in a Rug Doctor Wide Track machine, available from Spraying Systems Co., Wheaton, Ohio) and a fast dry jet tip 62 (preferably model 1/8K SS1.5 for narrower width spraying or model 1/8K SS2.5 for wider spraying, available from Spraying Systems Co., Wheaton, Ohio). The deep cleaning jet tip 60 is pointed downward and forcefully propels a stream of cleaning solution. Preferably, the surface cleaning (fast dry) jet tip 62 has a deflector surface (in the preferred model specified) and covers the same area of carpet as the deep cleaning jet tips 60. However, the presence of a deflector surface in fast dry tip 62 is also dependent upon the geometrical orientation of the jet tips 60, 62. Other tips with or without deflector surfaces can be used according to geometrical constraints.

The ball valve 42 is continuously fed diluted cleaning solution from the solution pump 38 and can be switched between first and second outlets, 70 and 72, respectively. When the ball valve 42 is aligned with the first outlet 70, cleaning solution is fed to a deep cleaning jet tip 60, and when the ball valve 42 is aligned with the second outlet 72 cleaning solution is fed to the fast dry jet tip 62.

The ball valve 42 of machine 10 is actuated by an actuator (shown generally at 78). The actuator comprises an indicator 76 and a shaft 77. The indicator 76 can be rotated between a first position 79 (shown) and a second position 80 (shown in shadow). Movement of the indicator 76 between the two positions 79, 80 selectively places the two types of jet tips 60, 62 in fluid communication with the cleaning solution.

In the first position 79, cleaning solution is fed to the deep cleaning jet tip 60. The machine 10 (e.g., the Rug Doctor Mighty Pack machine) may be configured to deliver a carpet-covering spray pattern at a rate of preferably between 0.52 to 0.55 GPM (gallons per minute), more preferably 0.54 GPM through the deep clean jet tip 60. A machine 10 configured to deliver a wider spray pattern, (e.g., the Rug Doctor Wide Track machine), may be configured to deliver preferably 0.60 to 0.70 GPM, more preferably 0.65 GPM. Other configurations may be used depending on the geometrical configuration requirements of different machines.

The second position 80 provides cleaning solution to a fast dry jet tip 62. A carpet cleaning machine (e.g., Rug Doctor Mighty Pack machine) may be configured to deliver preferably between 0.13 to 0.24 GPM, more preferably 0.17 to 0.21 GPM, and still more preferably 0.19 GPM. A carpet cleaning machine (e.g. Rug Doctor Wide Track machine) configured to deliver a wider spray pattern may be configured to deliver preferably between 0.19 to 0.32 GPM, more preferably 0.25 to 0.30 GPM, and still more preferably 0.28 GPM. Other configurations may be used depending on the geometrical configuration requirements of different machines. However, the preferred flow rates of the fast dry jet tip 62 should remain within 24% to 44% of the deep clean jet tip 60 flow rate for machines configured to deliver narrower spray patterns, and the fast dry jet tip 62 flow rate should remain within 29% to 49% of the deep clean jet tip 60 flow rate for machines configured to deliver wider spray patterns.

These application rates are a function of the two types of jet tips 60, 62 when used with the solution pump 38 of the invention. If conditions change whereby the pressure of the cleaning solution being delivered is changed then the application rates will also change but the ratio of the rates will remain the same. The nozzle configuration of the deep clean jet tip 60 coupled with the higher application rate results in a stream that penetrates deeply into the carpet. Conversely, the nozzle configuration of the fast dry jet tip 62 and the lower application rate results in a stream that spreads out over the surface of the carpet.

The storage section 16 comprises a solution tank 82. The top of the solution tank 82 includes an aperture 84 for use in filling the tank 82 with premixed cleaning solution. A screen (not shown) can be provided in the aperture 84 for the purpose of preventing sand and other debris from access to the tank 82. A port in the solution tank 82 supplies cleaning solution to the solution pump inlet 92.

Figure 1:
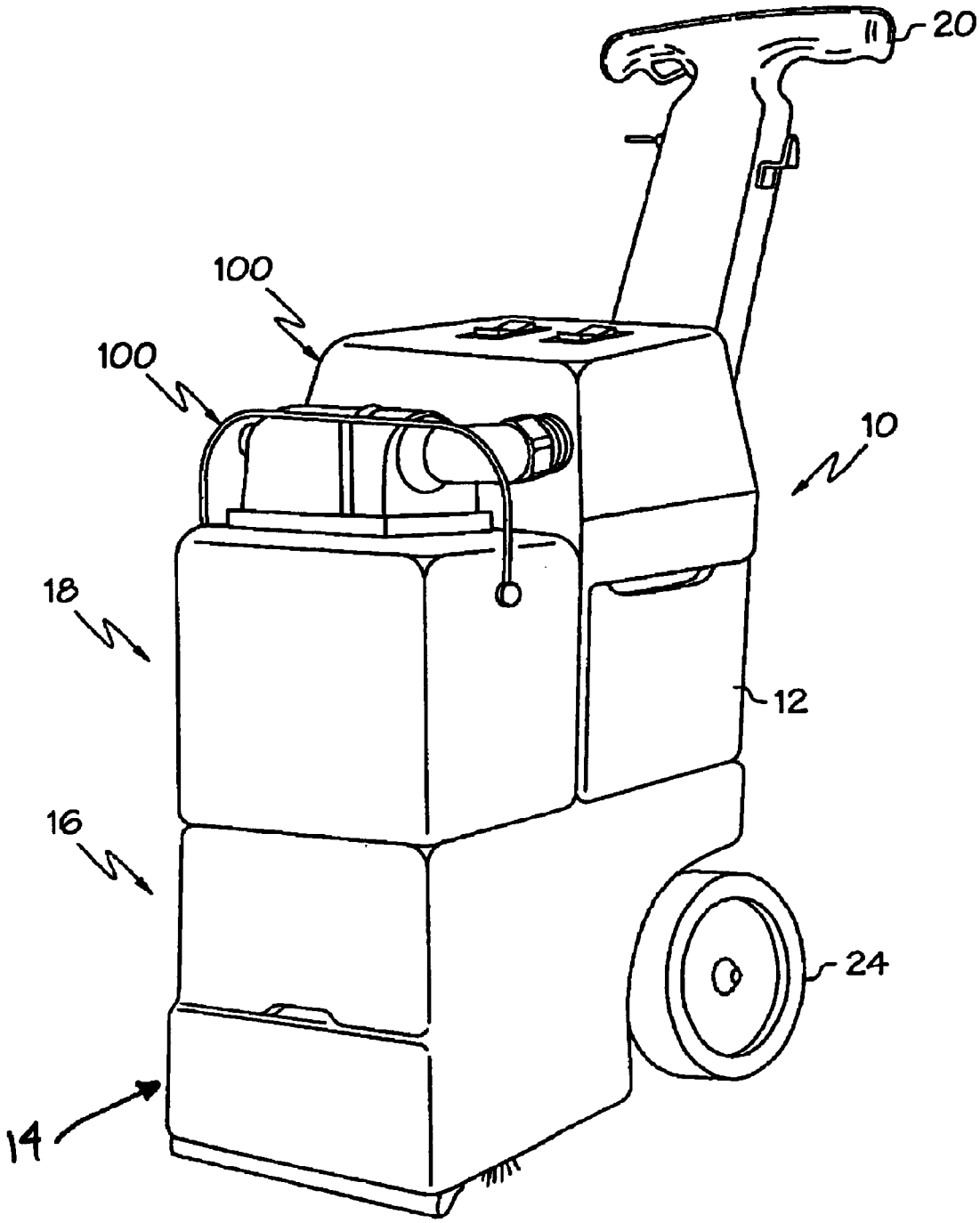
FIG. 1 illustrates an elevated perspective view of the carpet cleaning machine of the present invention.
Figure 2:
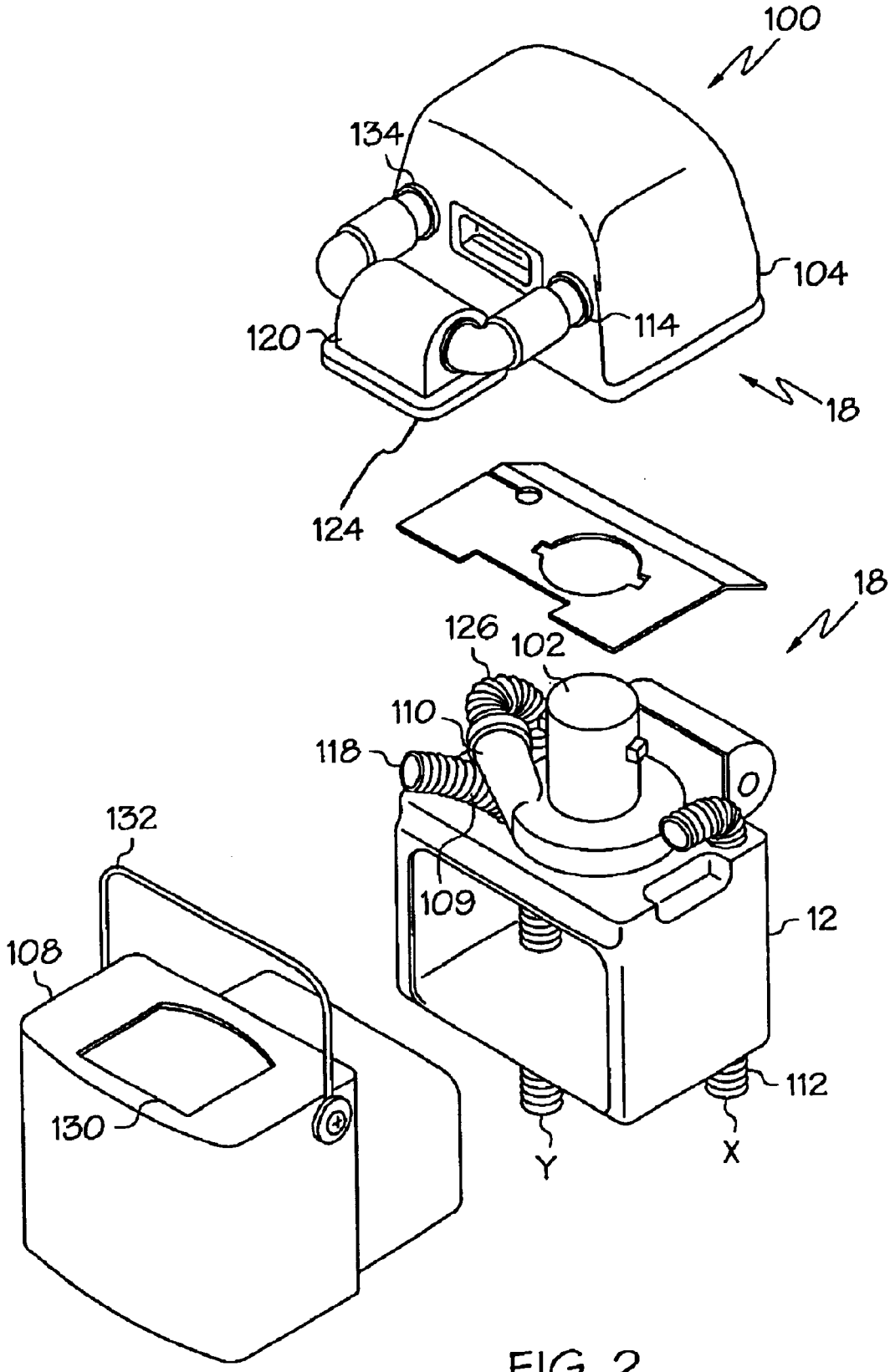
FIG. 2 illustrates an elevated, perspective exploded view of a removal section of the carpet cleaning machine of the present invention.

As shown in FIG. 2 the removal section 18 comprises a vacuum head and a waste recovery tank. The vacuum head shown generally at 100 is mounted on the main support housing 12 and includes a vacuum pump 102 or motor housed under a vacuum cover 104 that is attached to the main support housing 12. Adjacent the vacuum head 100 is a waste recovery tank 108. The air inlet 109 side (under the motor and not shown) of vacuum motor 102 is attached to an inlet conduit 118 which passes through an aperture 134 in the vacuum cover 104 and connects to one side of a dome 120. The vacuum motor creates suction to pull air and dirty water recovered from the carpet through nozzle 30 (best seen in FIG. 3). Dirty water and air travel through the removal conduit 32 (best seen in FIG. 3), up through a first conduit 112 (best seen in FIG. 2, FIG. 2 and FIG. 3 hoses match up at x and y), through an aperture 114 in the vacuum cover 104 and into dome 120. The dirty water and air hit a baffle (inside the dome 120 and not shown) and the dirty water drops into the recovery bucket 108 (FIG. 3). After traveling through the inlet conduit 118 into the vacuum motor 102, the air leaves through exhaust 110 and is directed into hose 126. Hose 126 goes down the main support housing 12 and exits out of the bottom of the machine (best seen in FIG. 2). The dome 120 has a gasket 124 about its base and is sealed about an aperture 130 in the top of recovery tank 108. The seal between the dome 120 and the recovery tank 108 is maintained by a bale 132 that doubles as a carrying handle for the recovery tank 108.

In a preferred embodiment, the vacuum nozzle 30 includes a pair of spaced triangular plates 140, 142, joined on two sides and open on the bottom, the rear plate of which has a fitting for attachment to the first conduit 112. The vacuum nozzle 30 preferably has an ear 144 and is held in the groove 146 with a single screw not shown. It will be appreciated by those skilled in the art, however, that the vacuum nozzle 30 may be attached by any suitable means known in the art.

The top of the cavity has a hollow extending into a notch 148 up the rear wall 150 of the clean water tank for receipt of the first conduit 112. A second notch 152 is provided in the rear wall 150 for receipt of the hose 126 which is vented through a rear panel 160. The rear panel 160 is attached to the pan 162 and the rear wall 150 of the clean water tank 82 with screws (not shown) or any other suitable means.

In use, as machine 10 is pulled rearwardly on wheels 24 by handle 20, premixed cleaning solution is drawn through strainer 90 in solution tank 82 through first tube 164 into the inlet 92 of solution pump 38. The cleaning solution is then forced from the outlet 55 of solution pump 38 into second tube 166, through selection mechanism 168 (comprising ball valve 42, indicator 76, and actuator 78) and delivered under pressure to spray nozzle chamber 40. Spray nozzle chamber 40 directs a spray of the solution onto a carpet just behind vibratory brush assembly 34. The wetted carpet is given a brief scrubbing and the cleaning solution immediately recovered with vacuum nozzle 140. Spent cleaning solution is sucked through conduit 112, into dome 120, where it is stopped by a baffle (not shown) and falls under gravity to the bottom of recovery tank 108.

B. The Cleaning Mixture

The carpet cleaning solution of the invention is a mixture comprising a detergent, foam stabilizer and an emulsifying agent. The solution is preferably a concentrate that can be diluted to different concentrations for use in different carpet cleaning modes of a dual mode carpet cleaning machine. A single compound may provide all three functions—detergency, stabilization, and emulsification—but it is preferred that at least two and more preferably three distinct compounds provide each individual function. In one embodiment, the carpet cleaning solution combines 1) an active detergent which may also function as a foaming agent, corrosion preventer, and a foam bubble-size reducer, and 2) an emulsifying agent which may also function as a profoamer, sheeting agent, and dispersing agent. These agents are referred to as the active agents of the invention. In addition, agents such as optical brighteners, deodorizers, water softeners, acid/base buffers, preservatives, and suspending agents may be added to optimize the carpet cleaning performance.

More preferably, the solution additionally includes: 3) a suspending agent which may also function as an incrustation inhibitor, an anti-redeposition agent, and a detergency booster; 4) a non-bleach optical brightener; and 5) a sequestering agent which may also function as an acidic/alkaline buffer and a soil dispersing agent. Finally, the solution may additionally include: 6) a preservative; 7) a water softener which may also function as an alkaline buffer; and 8) a fragrance or odor absorber.

The Active Detergent

The active detergent is preferably sodium lauryl sulfate (available from Para-Chem, Inc., Dalton, Ga.), but may also comprise an anionic detergent such as alkyl glyceryl ether sulfonates, alkyl sulfonates, alkyl monoglyceride sulfates or sulfonates, alkyl polyethoxy ether sulfonates, alkyl aryl sulfonates, aryl sarcosinates, aryl esters of isothionates, alkyl esters of sulfosuccinic acid, and alkyl phenol polyethoxy sulfonates. They are used in the form of water-soluble salts, such as, by way of example only, sodium, potassium and ammonium salts. Specific examples of the anionic organic detergents include sodium lauryl sulfate, sodium dodecyl sulfonate and sodium lauroyl sarcosinate.

The active detergent is more preferably a mixture of sodium lauryl sulfate and sodium lauroyl sarcosinate (available from Stephan Chemicals, Chicago, Ill.). It is believed the sodium lauroyl sarcosinate stabilizes the foam produced from agitating the carpet cleaning solution resulting in a drier foam with smaller and more uniform bubble size. The mixture of active detergents and the emulsifying agent below produces the unique properties of the invention upon increasing the concentration of the solution, e.g., from 4 oz./gallon to 8 oz./gallon, thereby imparting cleaning properties typical of current carpet cleaners at a lower concentration, but reduced drying time, cleaning activity with a drier, more stable foam, and increased sheeting action at higher concentrations. This also provides the advantage that the same carpet cleaning solution may be used in different concentrations in the same carpet cleaning machine to perform different functions.

The Emulsifying Agent

The emulsifying agent is preferably Silwet L-7608 (polyethyleneoxide modified trisiloxane copolymer, available from Osi Specialties, Inc., Greenwich, Conn.), but may comprise other compounds that increase the adhesion of the carpet cleaning solution to the carpet or increase the cross-link density of the carpet cleaning solution. It is believed that Silwet L-7608 aids foaming and foam stability and increases other properties such as viscosity, adhesion to the carpet, increased wetting of the carpet, and increased cross-linking of compounds within the foam. The emulsifying agent is also believed to function as a profoamer, sheeting agent, and dispersing agent.

The Sequestering Agent

The sequestering agent is preferably sodium tripolyphosphate ($Na_5P_3O_{10}$, available from Solutia, Inc., St. Louis, Mo.), but may also comprise other agents that provide sequestration of multivalent metal ions. The sequestering agent may also function as an acidic/alkaline buffer and a soil dispersing agent.

The Suspending Agent

The suspending agent is preferably Sokalan CP-9 (available from BASF, A.G., Germany), but may also comprise other polycarboxylate copolymers such as carboxylic acid copolymers, acrylic acid homopolymers, carboxymethyl cellulose, and nonionic copolymers such as polyvinylpyrrolidone. The suspending agents may also function as incrustation inhibitors, anti-redeposition agents, and as detergency boosters.

The Non-Bleach Optical Brightener

The non-bleach optical brightener is preferably Tinopal® (available from Ciba Specialty Chemicals, Greensboro, N.C.), but may also comprise other agents that absorb incipient, invisible UV light and convert it into visible light, e.g., UVITEX® (available from Ciba Specialty Chemicals, Greensboro, N.C.) or other agents that make the carpet appear brighter than the light which strikes it.

The Preservative

The preservative is preferably Dowicil-75 (1-(3-chloroallyl)-3,5,7-triaza-1-azoniaadamantane chloride, available from Dow Chemical Company, Midland, Mich.), but may comprise other compounds which provide antimicrobial activity.

The Water Softener

The water softener is preferably sodium sesqui-carbonate ($Na_2CO_3.NaHCO_3$ $2H_2O$ available from Solutia, Inc., St. Louis, Mo.) which may also function as an alkaline buffer. Other water softening agents may be used which provide a reduction in calcium or magnesium hardness.

The Fragrance

The fragrance is preferably a lemon scent (available from Chemia Corp., St. Louis, Mo.), but may also provide other agents which provide a pleasant scent or odor absorbance.

As one skilled in the art will observe from the above descriptions of the preferred agents of the carpet cleaning solution, the foam generated by agitation of the solution applied to a carpet will acquire different properties when applied in different concentrations. For example, when applied in a 4 oz./gallon concentration, the cleaning solution easily penetrates to the carpet backing material. It is believed that the foam stabilizer and emulsifier are dilute enough at this concentration to reduce foam persistence and viscosity so that the cleaning solution may easily penetrate the lower layers of the carpet fiber thereby providing excellent cleaning power.

When applied in an 8 oz./gallon concentration, however, the foam does not easily penetrate the carpet backing, but remains substantially in the upper layer of carpet fibers. It is believed that the foam stabilizer and emulsifier become increasingly cross-linked as concentrations increase so that the foam takes on the consistency of a gel rather than loosely organized and compacted bubbles. Thus, the agents mixed in the carpet cleaning solution form a more viscous and concentrated mass of foam staying on the upper layer of carpet fiber thereby concentrating the active agents on the upper layer. Thus, the benefit of the carpet cleaning solution of the invention is not only the ability to use the same carpet cleaning solution applied in different concentration to perform two different cleaning tasks, but concentrating the carpet cleaning solution and foam on the upper layer of carpet fibers allows the user to clean more quickly, using less carpet cleaning solution, with greater ease, and allowing faster drying times.

The carpet will be substantially dry within two hours of applying the carpet cleaning solution of the invention to the carpet, preferably in less than two hours, and more preferably less than one hour. As used herein, the term "substantially dry" is preferably defined to mean dry to the human touch. As used in the EXAMPLES below, however, substantially dry can be objectively determined by measuring the moisture content of a carpet using an RF monitor (model "Protimeter Aquant", available from Protimeter PLC, Marlow, United Kingdom). On a scale from 0 where no moisture is detected and 15 where 100% moisture saturation is detected, "substantially dry" is more preferably defined to mean obtaining less than a "level 3" reading on a scale of 15 of the RF Protimeter Aquant under normal temperature and humidity conditions, but in no case less dry than ambient humidity.

The preferred active agents of the carpet cleaning solution may be combined in different ranges depending on the desired characteristics the manufacturer may wish the solution and foam to embody. Generally, the formulation may comprise the eight agents mixed in amounts defined in TABLE 1 below. It will be appreciated, however, that the active agents may be applied alone in one embodiment of the invention.

TABLE 1

| Ingredient | Percent Weight | Percent Weight |
|---|---|---|
| Carboxylate Copolymer | 0.100 | 1.000 |
| Non-Bleach Optical Brightener | 0.001 | 0.0025 |
| 1-(3-chloroallyl)-3,5,7-Triaza-1-Azoniaadamantane Chloride | 0.012 | 0.012 |
| Sodium Tripoly-Phosphate | 3.000 | 6.000 |
| Sodium Sesqui-Carbonate | 3.000 | 6.000 |
| Sodium Lauryl Sulfate (30%) | 0.400 | 1.500 |
| Sodium Lauroyl Sarcosinate | 0.400 | 1.500 |
| Fragrance (Lemon) | 0.0375 | 0.075 |
| Polyethyleneoxide Modified Trisiloxane Copolymer | 0.250 | 2.000 |
| Water | Remainder | Remainder |
| Total | 100.00 | 100.00 |

While the formulation of the carpet cleaning solution may comprise individual components within the ranges specified in TABLE 1, the preferred concentrations of the components are listed in TABLE 2 as follows:

TABLE 2

| Ingredient | Percent Weight |
|---|---|
| Carboxylate Copolymer | 0.2500 |
| Non-Bleach Optical Brightener | 0.0015 |
| 1-(3-chloroallyl)-3,5,7-Triaza-1-Azoniaadamantane Chloride | 0.0120 |
| Sodium Tripoly-Phosphate | 4.8000 |
| Sodium Sesqui-Carbonate | 4.8000 |
| Sodium Lauryl Sulfate (30%) | 0.5000 |
| Sodium Lauroyl Sarcosinate | 0.5000 |
| Fragrance | 0.0375 |
| Polyethyleneoxide Modified Trisiloxane Copolymer | 0.5000 |
| Water | Remainder |
| Total | 100.00 |

The solution of TABLE 2 is hereinafter referred to as the "Preferred Solution."

C. The System

The invention contemplates a system which combines the machine of Part A with the Mixture of Part B. When the machine is set up for a deep clean operation, the cleaning solution is formed by mixing about 4 ounces of cleaning mixture per gallon of clean water. When the machine is set up for a Fast Dry surface clean operation the cleaning solution is formed by mixing about 8 ounces of cleaning mixture per gallon of clean water.

After cleaning in the Deep Clean mode, a typical carpet is, on average, approximately 91% clean and takes longer than 2 hours to dry. After a cleaning in the Fast Dry Surface Clean mode the typical carpet is, on average, approximately 86% clean and takes less than 2 hours to dry. The testing parameters and standards used to determine the above characteristics are discussed in the Part E Testing section below.

D. The Method

A method of cleaning is disclosed by the invention. After a survey of the area to be cleaned a user chooses to proceed with a Deep Clean application or a Surface Clean application. The machine is then set up for the application. First the user moves selection mechanism 168 to the proper position. Second the user prepares the cleaning solution tank by mixing 4 ounces of cleaning mixture per gallon of clean water when the Deep Clean application is selected or 8 ounces of cleaning mixture per gallon of clean water when the Fast Dry surface application is selected. Finally the area to be cleaned is cleaned.

E. Testing

To define terms, the term "Standard Machine" is a standard "Mighty Pack" machine, available from Rug Doctor, L. P., Fenton, Mo. and a "Fast Dry Machine" is a modified 0.19 gallon per minute delivery rate ("GPM") Mighty Pack machine. The track width of these machines is approximately 10.5 inches. Similar tests results were obtained using a modified 0.28 GPM "Wide Track" machine (available from Rug Doctor, L. P., Fenton, Mo.). The track width of this machine is approximately 12.5 inches. A 4 oz. per gallon solution of Steam Cleaner carpet cleaning solution (hereinafter "Steam Cleaner", available from Rug Doctor, L. P., Fenton, Mo.) and a 4 oz. per gallon concentration of the Preferred Solution (defined below) of the invention were compared to hot water.

Extensive testing was performed on carpets made from different materials of construction. The solutions were tested on a ⅜ inch pile height Nylon Saxony Plush carpet (FIG. 7), the most common type of carpet currently on the market. Similar results were derived from tests on Olefin loop and Nylon loop carpets. The carpet gauge was about 1/10 inch with 10 stitches per inch. The diluted solutions tested were approximately 110° F., ambient relative humidity between 21 to 32% and ambient temperature between 70 to 73° F.

Figure 7:
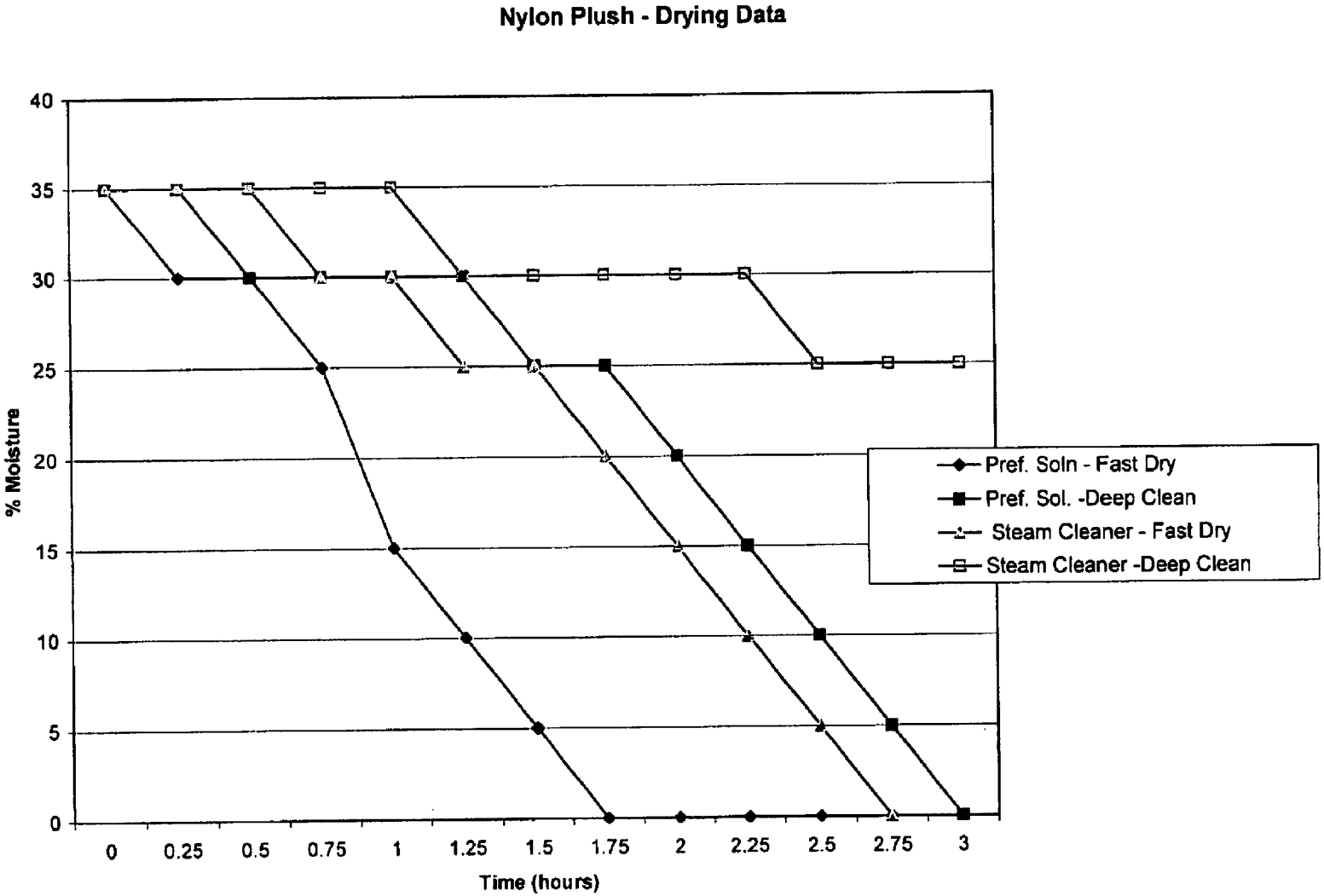
FIG. 7 is a chart which illustrates the results of a drying time test.

The tests show in FIG. 7 that the carpet cleaning system, when used with the Preferred Solution of the invention, at a concentration of 8 oz. per gallon dried in periods ranging from one to two hours, depending on the type of carpet tested. When the same carpets were cleaned with the standard Steam Cleaner solution in the Standard Machine at 4 oz. per gallon, the drying time was 3 to 7 hours depending on the type of carpet cleaned. When the carpets were cleaned with exactly the same concentration of the two cleaning solutions using the same machine, i.e., the Preferred Solution and the Steam Cleaner, the carpet cleaned with the Preferred Solution dried about 15% faster than that cleaned with the Steam Cleaner. This is believed to be due to the sheeting agent that allows the Preferred Solution to be spread into a thin film on the surface of the carpet fiber. The spreading of this film increases the surface area of the Preferred Solution and helps it dry quicker. The Active Detergent is also believed to be involved as the increased foam stability, increased viscosity, more uniform bubble size, and increased cross-linking between the polymers of the Emulsifying Agent and the Active Detergent act to keep the foam close to the top of the carpet fibers without penetrating to the carpet backing. Thus, the tests show that the combination of reduced flow and improved sheeting and foam characteristics of the Preferred Solution reduces drying time considerably.

Clean carpet strips were color measured using a Minolta Spectrophotometer (available from Minolta Corporation, Ramsey, N.J.) to determine an original color value. A standardized method of applying uniform soil to the carpet strips was developed to obtain precise and accurate measurements across data sets. The standardized method uses a jar mill with a Standard Soil mixture. The strips were then removed, vacuumed and color measured using the Minolta Spectrophotometer to determine a "Soil color" value. The soiled strips were then affixed to the floor. The carpet strips were then cleaned with the carpet cleaning solutions using a Deep Clean machine and a Surface Clean machine.

The carpet strips were cleaned with the Steam Cleaner and Preferred Solution using a Standard Machine for comparison. A linear cleaning rate of 30 feet per minute was used whenever possible. A pre-measured lateral overlap of two inches was allowed between strokes. The % Cleaning Efficiency was calculated after using the Minolta Spectrophotometer to determine the "clean color" value using the formula:

$$\% \text{ Cleaning Efficiency} = \frac{(\text{Clean Color value} - \text{Dirty Color value})}{(\text{Original Color value} - \text{Dirty Color value})} \times 100$$

Although the fast dry jet tips (delivering 0.19 GPM in the Mighty Pack machine and 0.28 GPM in the Wide Track machine) and deep clean jet tips (delivering 0.54 GPM in the Mighty Pack machine and 0.64 GPM in the Wide Track machine) of the invention are affected by the viscosity of the cleaning solutions and the pressure generated by the solution pump, the most important variable that was kept constant in the EXAMPLES below was the spray pattern. Different track widths, spray pattern widths, and liquid delivery rates are encompassed within the scope of the invention so long as the solution delivered by a dual mode machine is capable of producing the fast drying times presented in the invention. Other track widths, spraying patterns, spraying pattern widths, and jet tips may be used as one skilled in the art will observe.

EXAMPLE 1

Methods

A Standard Machine and a Fast Dry Machine were compared. A 4 oz. per gallon solution of Steam Cleaner and a 4 oz. per gallon Preferred Solution were used in the Standard Machine (applying the cleaning solutions at 0.54 GPM, or in the "deep cleaning mode") and Fast Dry Machine (applying the cleaning solutions at 0.19 GPM, or in the "surface cleaning mode") and were compared to hot water. The track width of these machines is approximately 10.5 inches. Similar tests results were obtained using a modified 0.28 GPM "Wide Track" machine (available from Rug Doctor, L. P., Fenton, Mo.). The track width of this machine is approximately 12.5 inches.

An acceptable cleaning standard for the Preferred Solution was arbitrarily targeted to be within 5% of the % cleaning efficiency result obtained from the MP machine using 4 oz./gallon of Steam Cleaner (87.33%−5%=82.33%). Test results show that the Preferred Solution in the preferred concentration actually improves the carpet cleaning results when comparing both the Preferred Solution of the invention and Steam Cleaner in the Standard Machine.

Figure 5:
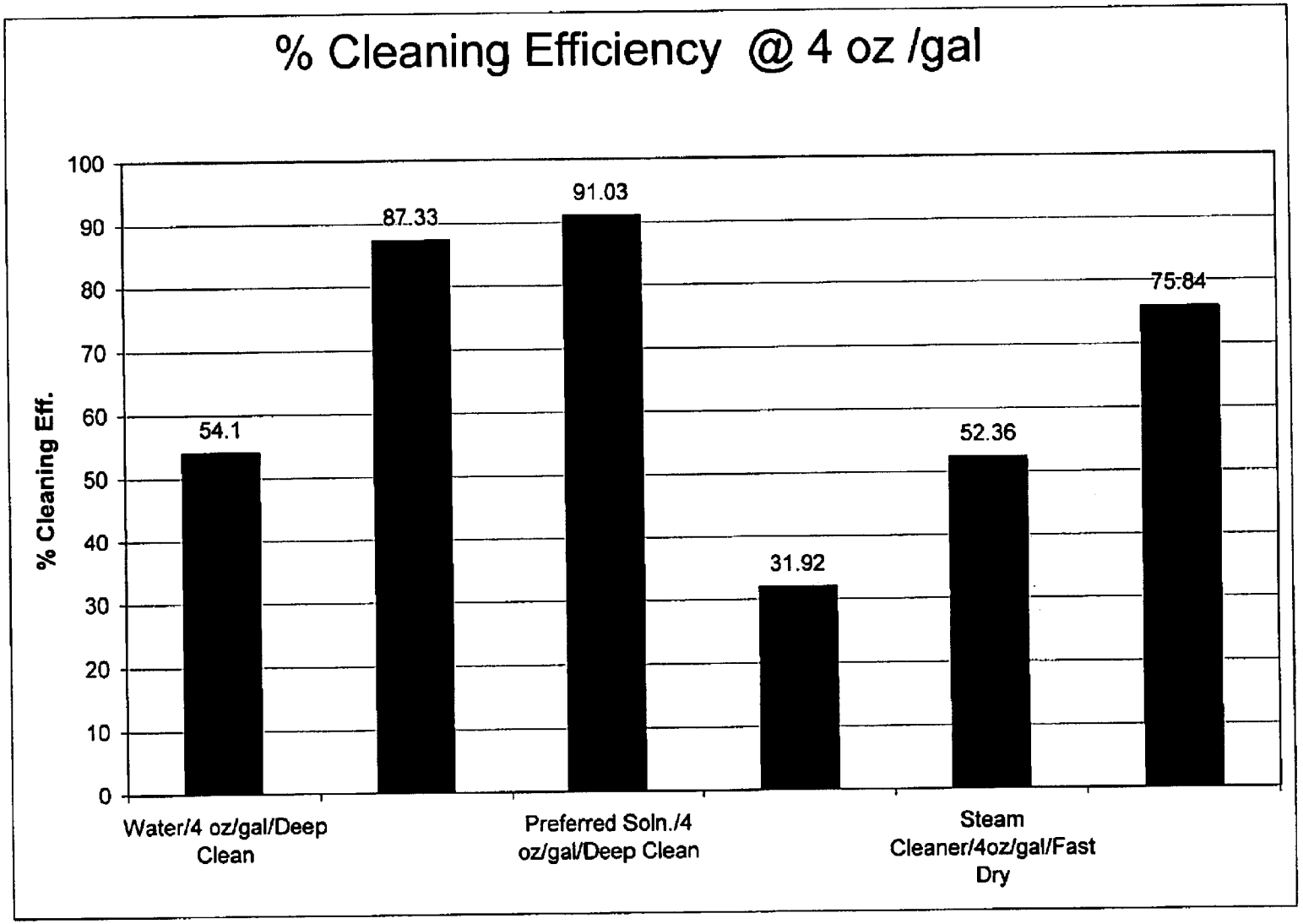
FIG. 5 is a chart which illustrates the results of a cleaning efficiency test.

FIG. 5 shows the results of this test:

(a) Cleaning with a 4 oz./gallon concentration of the Preferred Solution in the deep cleaning mode, the average % cleaning efficiency is 91.03%. Cleaning with Steam Cleaner showed an average % cleaning efficiency of 87.33% compared to a baseline level of 54.1% using hot water in the deep cleaning mode.

(b) Cleaning with a 4 oz./gallon concentration of the Preferred Solution in the surface cleaning mode, the average % cleaning efficiency is 75.84%. However, using 4 oz/gallon concentration of the Steam Cleaner in the surface cleaning mode, the average cleaning efficiency drops to 52.36%, while plain hot water can only show baseline cleaning efficiency of 31.92% in the surface cleaning mode.

Results

From EXAMPLE 1 (a), it is clear that the Preferred Solution outperforms the standard Steam Cleaner in the deep cleaning mode at 4 oz./gallon. This dilution is the preferred use level for the Preferred Solution in the deep cleaning mode.

From EXAMPLE 1(b), the results demonstrate that the cleaning performance of the Preferred Solution declines when used at 4 oz./gallon in the surface cleaning mode. However, the performance of the standard Steam Cleaner, at the same dilution decreases far more than that of the Preferred Solution. This demonstrates that a higher concentration of detergent is required for efficacious cleaning in the reduced flow mode.

EXAMPLE 2

Methods

Figure 6:
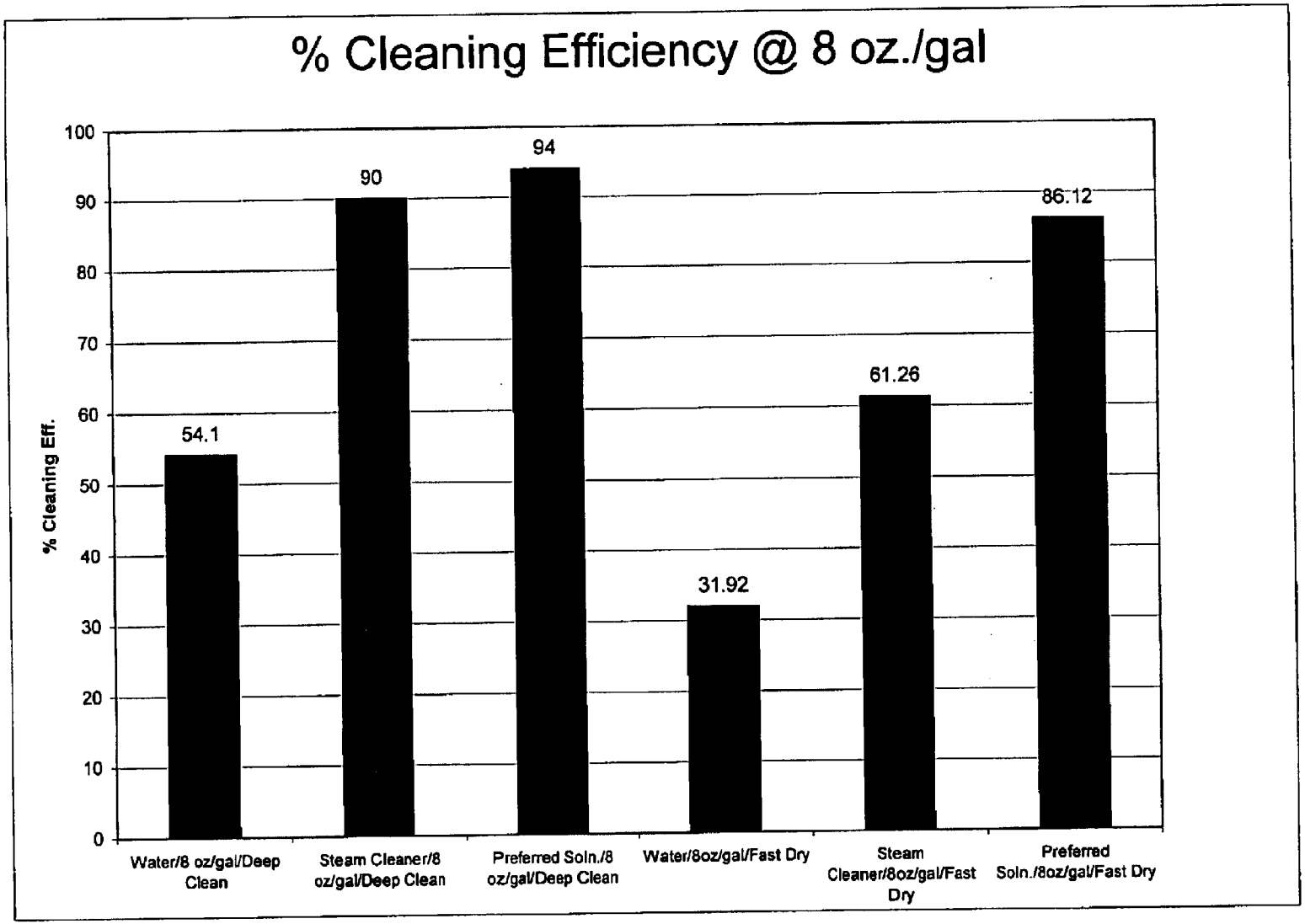
FIG. 6 is a chart which illustrates the results of a second cleaning efficiency test.

A Standard Machine and a Fast Dry Machine were compared. An 8 oz. per gallon solution of Steam Cleaner and an 8 oz. per gallon Preferred Solution were used in the Standard Machine and the Fast Dry Machine, and were compared to hot water. FIG. 6 shows the results of this test:

(a) Cleaning with a 8 oz./gallon concentration of the Preferred Solution in the deep cleaning mode, the average % cleaning efficiency is 94.0%. In comparison, cleaning with 8 oz./gallon concentration Steam Cleaner gave an average % cleaning efficiency of 90.0% and a baseline level of 54.1% using hot water, both in the deep cleaning mode.

(b) Cleaning with an 8 oz./gallon concentration of the Preferred Solution in the surface cleaning mode, the average % cleaning efficiency is 86.12%. However, using 8 oz./gallon concentration of Steam Cleaner in the surface cleaning mode, the average cleaning efficiency is merely 61.26%, while hot water can only show a baseline level of 31.92% in the surface cleaning mode.

Results

From EXAMPLE 2(a), the results show that the cleaning performance of the Preferred Solution and the standard Steam Cleaner is high (accepted performance levels when compared to the 82.33% benchmark of EXAMPLE 1) when used at 8 oz./gallon in the deep cleaning mode. However, from EXAMPLE 2(b), at 8 oz./gallon, the performance of the standard Steam Cleaner decreases to a "below acceptable" (below the 82.33% benchmark of EXAMPLE 1) level in the surface cleaning mode. At the same 8 oz./gallon concentration, the Preferred Solution shows an average cleaning efficiency that is acceptable in the surface cleaning mode. This dilution is the preferred use level for the Preferred Solution in the reduced flow mode.

Further experiments were run using carpets soiled in real-life conditions to obtain similar results. For example, cleaning a soiled carpet from a typical residence with an 8 oz./gallon concentration of the Preferred Solution in the surface cleaning mode, the average % cleaning efficiency improved to 88.42% from 86.12% in the controlled experiments. Thus, the slight variation in this result suggests that the results obtained in the laboratory will be comparable, if not better, in a real world environment.

A Nylon Saxony Plush carpet was used in this test, but similar results were obtained for various carpet fibers including Nylon Loop and Olefin Loop carpets.

Overall, it can be deduced from the above EXAMPLES that the Preferred Solution 1) provides acceptable cleaning in both the deep cleaning and surface cleaning modes of the carpet cleaning machine; 2) the preferred dilution ratios for the Preferred Solution are unique to the carpet cleaning machine of the invention; and 3) the combined performance of reduced drying time and cleaning efficiency cannot be achieved by using the standard Steam Cleaner solution.

The embodiments were chosen and described in order to best explain the principles of the invention and its practical application to thereby enable others skilled in the art to best utilize the invention in various embodiments and with various modifications as are suited to the particular use contemplated.

As various modifications could be made in the constructions and methods herein described and illustrated without departing from the scope of the invention, it is intended that all matter contained in the foregoing description or shown in the accompanying drawings shall be interpreted as illustrative rather than limiting. For example, ball valve 42 of selection mechanism 168 could be any multi-positional valve. In addition the two deep clean jet tips 60 could be replaced with a single jet tip 60. Thus, the breadth and scope of the present invention should not be limited by any of the above-described exemplary embodiments, but should be defined only in accordance with the following claims appended hereto and their equivalents.

What is claimed is:

1. A dual mode carpet cleaning machine having a deep cleaning mode and a surface cleaning mode comprising:

a selection mechanism to select between said deep cleaning mode and said surface cleaning mode, wherein the selection mechanism comprises a valve having a first position and a second position, an actuator attached to said valve such that operating said actuator moves said valve from said first position to said second position, and from said second position to said first position; said actuator including an indicator, said indicator having a first setting and a second setting such that said indicator displays said first setting when the valve is in said first position and displays said second setting when the valve is in said second position;

a support housing, the selection mechanism being on the support housing;

a source of liquid on the support housing;

a first liquid discharging jet tip on the support housing, the first jet tip being in communication with the source of liquid through the selection mechanism;

a second liquid discharging jet tip on the support housing, the second jet tip being in communication with the source of liquid through the selection mechanism, the selection mechanism being operable to alternatively select one of the first jet tip and the second jet tip for communication with the source of liquid and for discharging liquid from the source of liquid; and a spray nozzle chamber on the support housing, the spray nozzle chamber having an interior volume, and the first jet tip and the second jet tip being inside the spray nozzle chamber interior volume.

2. The dual mode carpet cleaning machine of claim 1, wherein the second jet tip delivers a liquid in a spray pattern with a width less than about 10.5 inches, preferably in the range of about 0.13 to 0.24 gallons per minute, more preferably 0.17 to 0.21 gallons per minute, and most preferably 0.19 gallons per minute.

3. The dual mode carpet cleaning machine of claim 1, wherein the second jet tip delivers a liquid in a spray pattern with a width greater than about 10.5 inches but less than about 12.5 inches, preferably in the range of about 0.19 to 0.32 gallons per minute, more preferably 0.25 to 0.30 gallons per minute, and most preferably 0.28 gallons per minute.

4. The dual mode carpet cleaning machine of claim 1, wherein the second jet tip delivers a liquid in a spray pattern with a width less than about 10.5 inches, in the range of about 24% to 44% the delivery of the first jet tip.

5. The dual mode carpet cleaning machine of claim 1, wherein the second jet tip delivers a liquid in a spray pattern with a width greater than about 10.5 inches but less than about 12.5 inches, in the range of about 29% to 49% the delivery of the first jet tip.

6. The dual mode carpet cleaning machine of claim 1, further comprising:

the first jet tip and the second jet tip having different liquid discharge flow rates.

7. The dual mode carpet cleaning machine of claim 1, further comprising:

a first conduit communicating the first jet tip with the selection mechanism and a second conduit communicating the second jet tip with the selection mechanism.

8. The dual mode carpet cleaning machine of claim 1, further comprising:

a brush mounted on the support housing for movement of the brush relative to the support housing, the brush being positioned adjacent the spray nozzle chamber.

9. The dual mode carpet cleaning machine of claim 8, further comprising:

a source of vacuum pressure on the support housing;

a vacuum nozzle on the support housing communicating with the source of vacuum pressure, the vacuum nozzle being positioned adjacent the brush.

10. The dual mode carpet cleaning machine of claim 9, further comprising:

a liquid recovery tank on the support housing, the liquid recovery tank communicating with the source of vacuum pressure and the vacuum nozzle.

11. The dual mode carpet cleaning machine of claim 1, further comprising:

the source of liquid being a solution tank on the support housing.

12. The dual mode carpet cleaning machine of claim 1 wherein the valve of the selection mechanism is a ball valve that is movable between first and second positions, in the first position the ball valve communicates the source of liquid with the first jet tip and in the second position the ball valve communicates the source of liquid with the second jet tip.

13. The dual mode carpet cleaning machine of claim 12 wherein the indicator of the ball valve is a manually operable indicator that is moved between first and second positions as the ball, valve is moved between the respective valve first and second positions.

14. The dual mode carpet cleaning machine of claim 12, further comprising:

a first conduit communicating the first jet tip with the ball valve and a second conduit communicating the second jet tip with the ball valve.

15. The dual mode carpet cleaning machine of claim 12, further comprising:

the source of liquid being a solution tank on the support housing.

16. The dual mode carpet cleaning machine of claim 12, further comprising:

a source of vacuum pressure on the support housing;

a vacuum nozzle on the support housing communicating with the source of vacuum pressure.

17. The dual mode carpet cleaning machine of claim 16, further comprising:

a liquid recovery tank on the support housing, the liquid recovery tank communicating with the source of vacuum pressure and the vacuum nozzle.

18. The dual mode carpet cleaning machine of claim 1, further comprising:

an application and extraction section attached to the support housing;

a storage section attached to the support housing and in fluid communication with the application and extraction section; and a removal section attached to the support housing.

19. The dual mode carpet cleaning machine of claim 18, further comprising:

a solution pump in the storage section, the solution pump having an inlet and an outlet; and a solution tank in the storage section, the solution tank being in fluid communication with the solution pump inlet.

20. The dual mode carpet cleaning machine of claim 18, further comprising:

a vacuum pump in the removal section, the vacuum pump having an intake and an exhaust;

a vacuum head in fluid communication with the vacuum pump;

a removal conduit in fluid communication with the vacuum pump intake; and a waste recovery tank in fluid communication with the vacuum pump exhaust.

21. A dual mode carnet cleaning machine having a deep cleaning mode and a surface cleaning mode comprising:

a selection mechanism to select between said deep cleaning mode and said surface cleaning mode, wherein the selection mechanism comprises a valve having a first position and a second position, an actuator attached to said valve such that operating said actuator moves said valve from said first position to said second position, and from said second position to said first position; said actuator including an indicator, said indicator having a first setting and a second setting such that said indicator displays said first setting when the valve is in said first position and displays said second setting when the valve is in said second position;

a support housing, the selection mechanism being on the support housing;

a source of liquid on the support housing;

a first liquid discharging jet tip on the support housing, the first jet tip being in communication with the source of liquid through the selection mechanism;

a second liquid discharging jet tip on the support housing, the second let tip being in communication with the source of liquid through the selection mechanism, the selection mechanism being operable to alternatively select one of the first let tip and the second jet tip for communication with the source of liquid and for discharging liquid from the source of liquid;

wherein the valve of the selection mechanism is a ball valve that is movable between first and second positions, in the first position the ball valve communicates the source of liquid with the first jet tip and in the second position the ball valve communicates the source of liquid with the second jet tip;

a first conduit communicating the first jet tip with the ball valve and a second conduit communicating the second jet tip with the ball valve; and a spray nozzle chamber on the support housing, the spray nozzle chamber having an interior volume, and the first and second jet tips being inside the spray nozzle chamber interior volume.

22. A dual mode carpet cleaning machine having a deer cleaning mode and a surface cleaning mode comprising:

a selection mechanism to select between said deer cleaning mode and said surface cleaning mode, wherein the selection mechanism comprises a valve having a first position and a second position, an actuator attached to said valve such that operating said actuator moves said valve from said first position to said second position, and from said second position to said first position: said actuator including an indicator, said indicator having a first setting and a second setting such that said indicator displays said first setting when the valve is in said first position and displays said second setting when the valve is in said second position;

a support housing, the selection mechanism being on the support housing;

a source of liquid on the support housing;

a first liquid discharging jet tip on the support housing, the first jet tip being in communication with the source of liquid through the selection mechanism;

a second liquid discharging jet tip on the support housing, the second jet tip being in communication with the source of liquid through the selection mechanism, the selection mechanism being operable to alternatively select one of the first jet tip and the second let tip for communication with the source of liquid and for discharging liquid from the source of liquid;

an application and extraction section attached to the support housing;

a storage section attached to the support housing and in fluid communication with the application and extraction section;

a removal section attached to the support housing;

a vacuum nozzle in the application and extraction section;

a brush in the application and extraction section adjacent the vacuum nozzle; and a motor operatively connected to the brush for moving the brush when the motor is operated.

23. A dual mode carpet cleaning machine having a deep cleaning mode and a surface cleaning mode comprising:

a selection mechanism to select between said deep cleaning mode and said surface cleaning mode, wherein the selection mechanism comprises a valve having a first position and a second position;

a support housing, the selection mechanism being on the support housing;

a source of liquid on the support housing;

a first liquid discharging jet tip on the support housing, the first jet tip being in communication with the source of liquid through the selection mechanism;

a second liquid discharging jet tip on the support housing, the second jet tip being in communication with the source of liquid through the selection mechanism, the selection mechanism being operable to alternatively select one of the first jet tip and the second jet tip for communication with the source of liquid and for discharging liquid from the source of liquid; and a spray nozzle chamber on the support housing, the spray nozzle chamber having an interior volume, and the first jet tip and the second jet tip being inside the spray nozzle chamber interior volume.

24. A dual mode carpet cleaning machine having a deep cleaning mode and a surface cleaning mode comprising:

a selection mechanism to select between said deep cleaning mode and said surface cleaning mode, wherein the selection mechanism comprises a valve having a first position and a second position;

a support housing, the selection mechanism being on the support housing;

a source of liquid on the support housing;

a first liquid discharging jet tip on the support housing, the first jet tip being in communication with the source of liquid through the selection mechanism;

a second liquid discharging jet tip on the support housing, the second jet tip being in communication with the source of liquid through the selection mechanism, the selection mechanism being operable to alternatively select one of the first jet tip and the second jet tip for communication with the source of liquid and for discharging liquid from the source of liquid;

an application and extraction section attached to the support housing;

a storage section attached to the support housing and in fluid communication with the application and extraction section;

a removal section attached to the support housing;

a vacuum nozzle in the application and extraction section;

a brush in the application and extraction section adjacent the vacuum nozzle; and a motor operatively connected to the brush for moving the brush when the motor is operated.

* * * * *

UNITED STATES PATENT AND TRADEMARK OFFICE

CERTIFICATE OF CORRECTION

PATENT NO. : 6,789,290 B2 
DATED : September 14, 2004
INVENTOR(S) : Roger Kent, Frank Stephan and Schubert Pereira It is certified that error appears in the above-identified patent and that said Letters Patent is hereby corrected as shown below:

Column 14,
Line 46, delete "," after -- ball --.

Column 16,
Line 1, should read -- ...machine having a deep --.
Line 3, should read -- ...select between said deep clean --.

Signed and Sealed this

Sixteenth Day of August, 2005

JON W. DUDAS
*Director of the United States Patent and Trademark Office*